US010264847B2

(12) United States Patent
Oloff

(10) Patent No.: US 10,264,847 B2
(45) Date of Patent: Apr. 23, 2019

(54) FOOTWEAR WITH METATARSAL OFFLOADING

(71) Applicant: Joan Oloff, Los Gatos, CA (US)

(72) Inventor: Joan Oloff, Los Gatos, CA (US)

( * ) Notice: Subject to any disclaimer, the term of this patent is extended or adjusted under 35 U.S.C. 154(b) by 0 days.

(21) Appl. No.: 14/138,192

(22) Filed: Dec. 23, 2013

(65) Prior Publication Data

US 2014/0298680 A1 Oct. 9, 2014

Related U.S. Application Data

(60) Provisional application No. 61/808,050, filed on Apr. 3, 2013.

(51) Int. Cl.
*A43B 7/14* (2006.01)
*A43B 21/00* (2006.01)

(52) U.S. Cl.
CPC ..... *A43B 7/142* (2013.01); *A43B 7/1425* (2013.01); *A43B 7/1435* (2013.01); *A43B 7/1445* (2013.01); *A43B 21/00* (2013.01)

(58) Field of Classification Search
CPC ..... A43B 7/1425; A43B 7/1445; A43B 7/145; A43B 7/148; A43B 7/142
See application file for complete search history.

(56) References Cited

U.S. PATENT DOCUMENTS 4,794,707 A * 1/1989 Franklin et al. ..... 36/107
4,866,860 A 9/1989 Blissett et al.
5,025,573 A 6/1991 Giese et al.
5,435,077 A 7/1995 Pyle
5,724,753 A * 3/1998 Throneburg et al. ..... 36/91
6,038,790 A * 3/2000 Pyle et al. ..... 36/30 R
7,047,669 B2 * 5/2006 Polcek ..... 36/25 R
7,231,729 B2 6/2007 Heierling et al.
7,614,164 B2 11/2009 Morales et al.
2003/0150131 A1 * 8/2003 McManus et al. ..... 36/28
2004/0181970 A1 * 9/2004 Covatch ..... 36/30 R
2005/0268490 A1 * 12/2005 Foxen ..... 36/28
2006/0026867 A1 * 2/2006 Polcek ..... 36/44
2006/0242860 A1 * 11/2006 Canvin ..... 36/83
2007/0033834 A1 * 2/2007 Cheskin et al. ..... 36/44
2007/0151124 A1 * 7/2007 Chan ..... 36/35 R
2007/0234590 A1 * 10/2007 Morales et al. ..... 36/24.5
2008/0086916 A1 * 4/2008 Ellis ..... 36/103
(Continued)

*Primary Examiner* — Megan E Lynch
(74) *Attorney, Agent, or Firm* — Global Intellectual Property Agency, LLC; Daniel Boudwin

(57) ABSTRACT

A high heeled shoe and shoe sole insert are provided that are configured to provide relief from the forces on the foot created by walking in high heels. The shoe comprises a layered sole having an outsole, a midsole, and an insole. The midsole of the shoe comprises a cutout that is positioned over the metatarsal pressure point of the user's foot when positioned within the shoe. The cutout is filled with a shock absorbing material, such as Ethylene-vinyl acetate (EVA) foam, and includes a layer of paperboard for further cushioning. The shoe sole insert similarly includes a metatarsal padded region and a medial longitudinal arch pad to provide a layer of cushioning above the midsole of a user's footwear. The present invention provides relief while wearing high heels by cushioning the user's foot in high pressure zones, thereby relieving the pressure and reducing injuries or soreness.

2 Claims, 2 Drawing Sheets

(56) References Cited

U.S. PATENT DOCUMENTS

| | | | | |
|---|---|---|---|---|
| 2008/0222918 | A1* | 9/2008 | Hesse | 36/43 |
| 2009/0007455 | A1* | 1/2009 | Montgomery | 36/91 |
| 2009/0094856 | A1* | 4/2009 | Guerra | 36/29 |
| 2009/0188131 | A1* | 7/2009 | Doerer et al. | 36/88 |
| 2009/0193683 | A1* | 8/2009 | Igdari | 36/91 |
| 2010/0146816 | A1* | 6/2010 | Cappaert et al. | 36/91 |
| 2011/0041360 | A1* | 2/2011 | Torrance et al. | 36/91 |
| 2011/0067269 | A1* | 3/2011 | Luo | 36/103 |
| 2011/0072685 | A1* | 3/2011 | Gutowsky et al. | 36/44 |
| 2011/0099845 | A1* | 5/2011 | Miller | 36/91 |
| 2011/0179672 | A1* | 7/2011 | Cheng | 36/71 |
| 2012/0096745 | A1 | 4/2012 | Donato | |
| 2012/0255199 | A1* | 10/2012 | Tzeng | 36/43 |
| 2012/0272545 | A1* | 11/2012 | Chenut | 36/43 |
| 2012/0324758 | A1* | 12/2012 | Tang | 36/28 |
| 2013/0326914 | A1* | 12/2013 | Lopez | 36/34 R |

* cited by examiner

FOOTWEAR WITH METATARSAL OFFLOADING

CROSS REFERENCE TO RELATED APPLICATION

This application claims the benefit of U.S. Provisional Application No. 61/808,050 filed on Apr. 3, 2013, entitled "High-Heeled Footwear with Metatarsal Offloading." The above identified patent application is herein incorporated by reference in its entirety to provide continuity of disclosure.

BACKGROUND OF THE INVENTION

Field of the Invention

The present invention relates to footwear. More particularly, the present invention pertains to high-heeled footwear and footwear inserts that attenuate the pressure exerted onto the metatarsal and heal region of the foot.

High-heeled shoes are a style of footwear that raises the heel of a wearer's foot to a higher position than the toes. High heels are often worn for aesthetic reasons, as they provide the illusion that the wearer has longer and more slender legs. Conventional high heels generally include a heel section ranging from two to five inches in length, and a toe region positioned closer to ground level to angle the wearer's heel upwards. The shoe is available in a wide range of female styles that range from stilettos, pumps, peep-toes, wedges, to platforms. High heels can also be found for men in the form of cowboy boots and Cuban heels.

High-heeled shoes are often designed for aesthetics, with little regard for how they affect the biomechanics of the foot. As can be appreciated, walking with an elevated heel places a higher load on the metatarsal region of the foot as the weight of the body is shifted forward. This additionally causes a forward pelvic tilt, which requires a user to lean backwards in order to maintain balance. The corrective orientation places additional strain on the hips and lower back. Another condition created by high heels is overarching of the back, which creates a forward head posture that may strain the muscles of the neck. Furthermore and in addition this hip and back pain, high heels create anterior loading on the subchondral bone, which causes anterior knee pain, which can also shorten the gastronomies, soleus, and Achilles tendon, leading to muscle spasms and pain.

There are a variety of devices that attempt to relieve pressure on the foot. One such solution is to provide a cushioned insert that is configured for placement over the insole of a shoe. These inserts, however, often are poorly fit within the shoe and result in slipping and sliding within the shoe. Moreover, because these inserts are placed on top of the insole, they raise the user up within the shoe. This causes the user to have a center of gravity that was not intended with the design of the shoe. What is needed is a shock absorbing shoe insert that provides relief without compromising the original design of the shoe.

The present invention overcomes the problems inherent in traditional footwear with a high heel sole. The device comprises a high-heeled shoe platform having a cutout in the midsole of the shoe. The cutout is positioned over the metatarsal pressure point and provides a recess for the addition of padding, such as EVA foam. The recess is then covered with paperboard. Affixed over the paperboard is a padded insole that supports the foot and prevents rotation thereof when walking or standing. The insole may comprise a unitary material or may comprise the padded shoe sole insert of the present invention. Use of the present shoe and insert helps to offload the pressure that would otherwise be exerted onto the metatarsal, thereby providing a more comfortable article of footwear.

Description of the Prior Art

Devices have been disclosed in the prior art that relate to shock absorbing inserts. These include devices that have been patented and published in patent application publications. These devices generally relate to foam inserts that are placed in shoes. The following is a list of devices deemed most relevant to the present disclosure, which are herein described for the purposes of highlighting and differentiating the unique aspects of the present invention, and further highlighting the drawbacks existing in the prior art.

One such prior art device, U.S. Pat. No. 4,866,860 to Blissett provides a metatarsal cushioning shoe portion that includes a flexible forefoot portion. A resilient foam material is positioned in an aperture formed in the metatarsal head support area in the bottom of a shoe. Although the prior art device of Blissett is similar in nature and relevant to the present invention, it fails to provide a midsole insert for high heeled shoes.

Another prior art device, U.S. Pat. No. 5,025,573 to Giese provides a shoe bottom having a lower layer of a firm material, and an upper softer layer attached thereto. The upper layer has an upper surface that is shaped to fit the bottom of the foot of a user. The device however, fails to provide a foam insert that is insertable within a cavity of the midsole of a shoe.

U.S. Pat. No. 5,435,077 to Pyle teaches a layered cushioning system configured for the sole of a woman's pumps. The sole comprises a flexible polyurethane outsole containing a recess in the upper forepart of the shoe. Within the recess is a molded a shock-absorbing foam insert. While the shoe of Pyle is similar to that of the present invention, it fails to provide a shock absorbing foam configured to offload the forces of the metatarsal area that occur during walking.

U.S. Pat. No. 7,231,729 to Heierling provides a ski boot that comprises a stiff outer boot and a soft inner lining for receiving the foot of a skier. The sole of the ski boot includes an elastic zone that devices the sole into front and rear portions, thus enabling the sides to pivot with each other. The ski boot of Heierling, however, fails to provide a midsole cutout that comprises a shock absorbing foam.

Another prior art device, U.S. Pat. No. 7,614,164 to Morales provides a shoe having a multilayered sole with embedded padding. One of the layers includes a sheet of base material having a hole through its central region. A cushioning pad may be attached to the base so as to fill the hole. However, while the device is similar in nature and relevant to the present invention, it fails to provide a longitudinal arch cushioning insert.

Finally, U.S. Patent Publication No. 2010/0096745 to Donato provides a shoe insole, whereby the insole comprises a cavity in the area of the metatarsal region of the foot and is configured to relieve a portion of the direct pressure from the insole against the metatarsal region. The prior art of Donato, however, fails to provide a longitudinal arch cushioning insert.

The present invention, however, alleviates the shortcomings of the shoe articles and shoe inserts of the prior art. The present invention comprises a high-heeled shoe with a padded inserts configured to offload the pressures associated with walking in high heeled shoes. The high heel shoe comprises an insole, midsole, and outsole. Within the midsole is a cavity that comprises a padded member, wherein the member is positioned along the metatarsal region of the user's foot. Several layers are provided for increased padding, while a cushioned insert is further provided for cushioned locomotion. The shoe and the insert are both designed to alleviate discomfort and pressure while walking in a high heeled shoe.

The present invention substantially diverges in design elements from the prior art and consequently it is clear that there is a need in the art for an improvement to shock absorbing foam inserts. In this regard the instant invention substantially fulfills these needs.

SUMMARY OF THE INVENTION

In view of the foregoing disadvantages inherent in the known types of sole inserts and high heeled shoes now present in the prior art, the present invention provides a new shoe midsole design wherein the same can be utilized for providing convenience for the user when relief while wearing high heeled shoes is desired.

It is therefore an object of the present invention to provide a new and improved shoe midsole that has all of the advantages of the prior art and none of the disadvantages.

It is another object of the present invention to provide a shoe design that provides relief for a user wearing high heeled shoes.

Another object of the present invention is to provide shoe design that positions padding over the metatarsus head region of the foot.

Yet another object of the present invention is to provide a shoe design that is positioned along the longitudinal arch of the foot.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
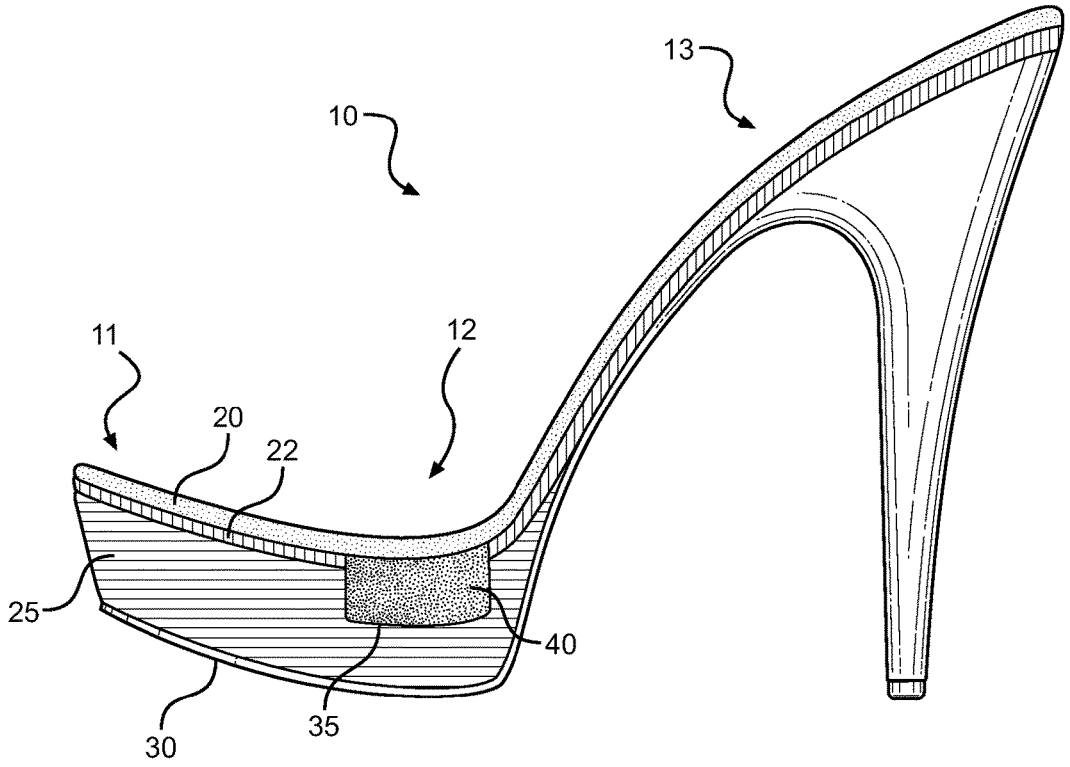
FIG. 1A shows a cross-sectional view of the shoe and insert design of the present invention.

Reference is made herein to the attached drawings. Like reference numerals are used throughout the drawings to depict like or similar elements of the sole insert. For the purposes of presenting a brief and clear description of the present invention, the preferred embodiment will be discussed as used for providing relief for a person wearing high heeled shoes. The figures are intended for representative purposes only and should not be considered to be limiting in any respect.

Referring now to FIG. 1A, there is shown a cross-sectional view of the high heel shoe of the present invention, whereby the shoe includes a padded insert that is configured for shock absorption and includes a metatarsal head cutout 35 therein for additional padding. The sole of the high heel shoe 10 includes a modified design, comprises an insole 20, a midsole 25, and an outsole 30 section vertically disposed therethrough and adapted to alleviate pain while walking therein. From front to back, the sole comprises a forward toe portion 11, a metatarsal head region 12 and a rear heel portion 13.

The midsole cutout 35 is a cavity within the midsole 25 that is filled with a shock absorbing material 40. The shock absorbing material 40 provides cushioning to the metatarsal head region of the user's foot when positioned therein, which helps to offload the pressure that would otherwise be exerted onto the metatarsal head region of the user when walking and standing. The shock absorbing material 40 is preferably comprised of Ethylene-vinyl acetate (EVA) foam, also known as "expanded rubber" or "rubber foam". Shape of the shoe and the relative heights of the forward toe portion 11, a metatarsal head region 12 and a rear heel portion 13 are configured to position the metatarsal head region of the user's foot over the cutout 35, which creates a posterior shift the wearer's center of gravity and positions the cutout 35 in the optimum location to absorb energy. The shape of the shoe also lessens the pelvic tilt of the wearer, thereby lessening the degree to which the wearer leans backwards to maintain balance. The posterior shift also reduces strain on the knees, hips, and lower back.

A layer of paperboard 22 is positioned above the midsole 25 to further dissipate the forces of impact while a user is walking or standing. The paperboard 22 may include an open portion adapted to accept therethrough the shock absorbing material 40 of the midsole 25 (FIGS. 1A and 1B) or the paperboard 22 may be coextensive with the midsole 25 and be positioned over the shock absorbing material 40 thereof. The insole 20, which comprises either a uniform foam padding material or a composite design, is positioned over the paperboard 22 layer. The combination of the insole layers serves to provide a cushioning layer configured for dissipating the forces that act on the foot of a user during use of high heels.

Figure 1B:
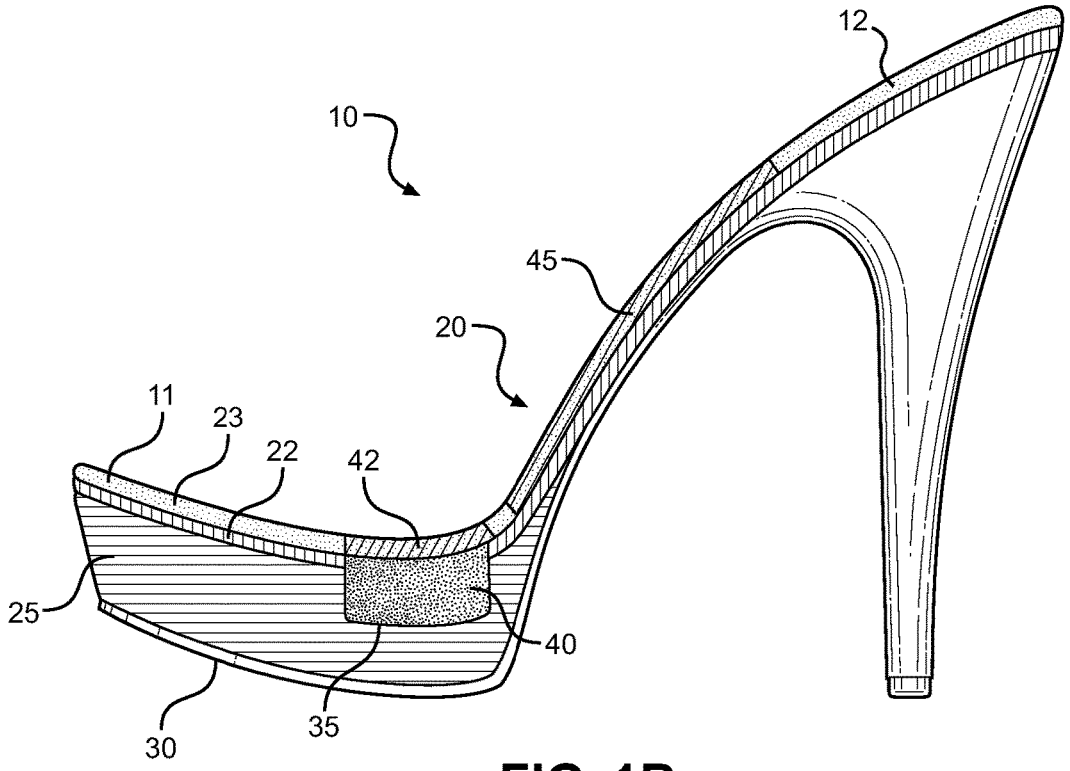
FIG. 1B shows a cross-sectional view of the shoe with metatarsal head and medial longitudinal padded inserts.

Referring now to FIG. 1B, there is shown a cross-sectional view of the high heel shoe 10, whereby the insole 20 of the shoe includes multiple padded regions that are configured for shock absorption. The insole 20 shown in FIG. 1B is a composite design having a defined a forward toe portion 11, a metatarsal padding region 42, a medial longitudinal arch pad 45, and a rear heel portion 12. The metatarsal padding region 42 comprises a foam padded region forward for the longitudinal arch pad 45 along the insert, while the medial longitudinal arch pad 45 thereof is orthopedically shaped to follow the curve of the user's medial longitudinal arch to provide support thereto. This insole 20 design provides support to the medial arch, helps to control excessive pronation or foot flattening, and prevents foot, leg and lower back fatigue. The metatarsal padding region 42 is positioned over the cutout 35 in the midsole 25, which provides support to the metatarsal region of the foot and offloads pressure that is concentrated on the ball of the foot. The combination of the metatarsal shock absorbing material 40 of the midsole, the metatarsal padding region 42 thereover, and the longitudinal arch padding 45, the assembly provides considerable foot pain relief while wearing the shoe 10.

Figure 2:
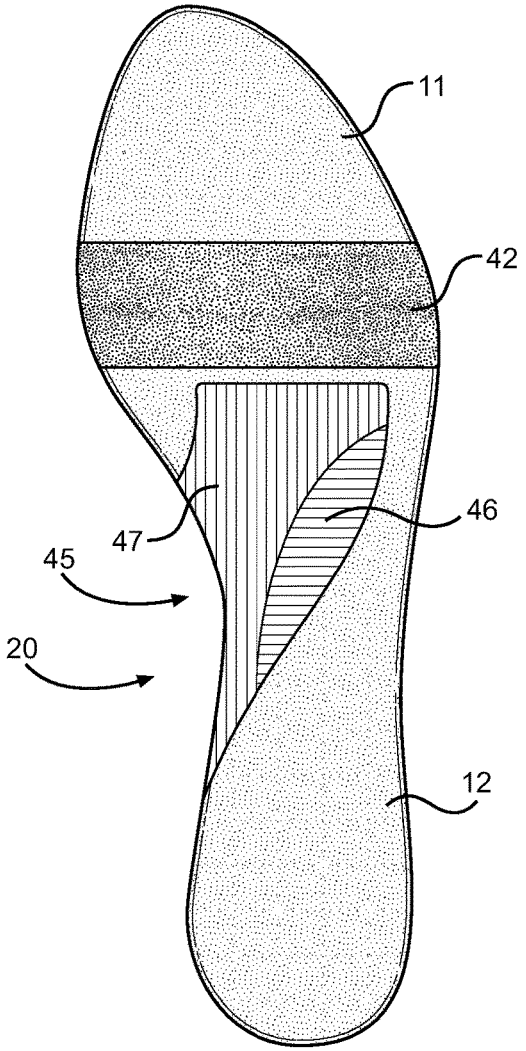
FIG. 2 shows an overhead view of the padded inserts within the sole of the shoe.

Referring now to FIG. 2, there is shown an overhead view of the composite padded insert 20 adapted to be positioned within the sole of a high heeled shoe and above the midsole. The composite padded insert 20 comprises a forward toe portion 11, a metatarsal padding region 42, a medial longitudinal arch pad 45, and a rear heel portion 12. The metatarsal padding region 42 extends laterally across the insert, while the medial longitudinal arch pad 45 is an arch-shaped pad aft of the metatarsal padding region 42. The metatarsal padding region 42 and the longitudinal pads 45 are preferably comprised of a shock absorbing foam, such as EVA, for shock absorption and energy attenuation received directly from the bottom of a user's foot. The metatarsal padding region 40 is adapted to be placed over the padded cutout of the midsole and the medial longitudinal arch pad 45 contours to the user's arch, wherein both are padded and retain their position along the interior of the shoe by way of the shape of the insert. The shape of the insert is the same as the shape of the shoe and is coextensive therewith, which comprises a rear heel portion, a metatarsal head region and a toe portion.

The medial longitudinal arch pad 45 comprises a contoured layer of shock absorbing material that includes a first thickness region 46 and a second thickness region 47. The thickness of the first region 46 is preferably less than the thickness of the second region 47. The medial longitudinal arch pad 45 contours to the natural lines of a user's arch and provides a pad thereunder to fill the natural gap between the user's arch and the insole, or to support an otherwise pronating arch of a user while walking.

Figure 3:
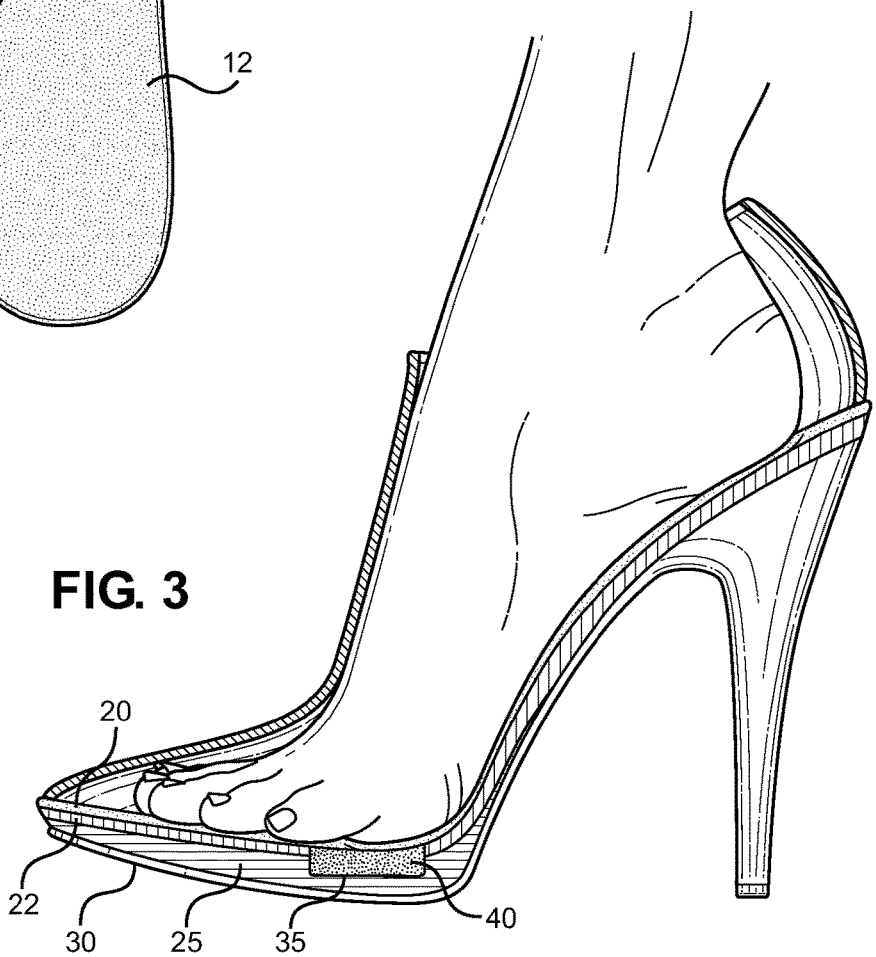
FIG. 3 shows a cross-sectional view of a user's foot within the shoe of the present invention.

Referring now to FIG. 3, there is shown a cross-sectional view of a user's foot within the shoe of the present invention, wherein the uniform insole 20 is shown. A paperboard layer 22 is positioned between the midsole 25 and the padded insole 20, where in the paperboard layer 22 covers the padded cutout 35 thereof. The paperboard 22 absorbs the pressure exerted on the sole of the shoe below the insole, and provides a springboard effect in the metatarsal region of the foot. As the weight of the wearer transfers to the metatarsal region, it compresses the paperboard 22 and shock absorbing material 40 within the cutout 35, which distributes the forces that would otherwise be transferred from the shoe and into the foot. The paperboard 22 and shock absorbing material 40 compress, dissipate the force, and spring back to their original position.

The depth and positioning of the metatarsal region cutout can be adapted to ensure a proper posterior shift of the wearer's center of gravity is achieved. Additionally, the location of the medial longitudinal arch pad 45 and metatarsal padding region 42 can be tailored within the padded insole 20 to ensure proper offloading occurs. In an alternative embodiment, the present invention can include a cutout aperture in the paperboard 22 that aligns with the metatarsal region. The aperture creates an opening for the inclusion of EVA foam to support the metatarsal region in place of conventional paperboard. This provides additional offloading in the metatarsal region.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A high heeled shoe, consisting of:

a sole comprising an outsole, a midsole, and an insole;

said sole comprises a forward toe portion, a metatarsal head region and a rear heel portion;

the forward toe portion configured to correspond in position to a toe region of a wearer's foot;

the metatarsal head region configured to correspond in position to a metatarsal region of the wearer's foot;

whereby said midsole is covered by a coextensive layer of paperboard disposed between said midsole and said insole;

the midsole and the coextensive layer of paperboard comprising a single cutout positioned at the metatarsal head region, the single cutout contained entirely within the metatarsal head region;

the single cutout having a depth less than a depth of the midsole, wherein the single cutout extends through more than one layer of the sole;

a shock absorbing material positioned within and enclosed by the single cutout, the shock absorbing material sandwiched between the insole and a lower surface of the single cutout;

whereby said shock absorbing material is adapted for attenuating forces in the metatarsal region of user's foot while walking.

2. A high heeled shoe, consisting of:

a sole comprising an outsole, a midsole, and an insole;

said sole comprises a forward toe portion, a metatarsal head region and a rear heel portion;

the forward toe portion configured to correspond in position to a toe region of a wearer's foot;

the metatarsal head region configured to correspond in position to a metatarsal region of the wearer's foot;

whereby said midsole is covered by a coextensive layer of paperboard disposed between said midsole and said insole;

the midsole and the coextensive layer of paperboard comprising a single cutout positioned at the metatarsal head region, the single cutout contained entirely within the metatarsal head region;

wherein the single cutout extends entirely from an outermost lateral edge of the sole to an outermost medial edge of the sole;

the single cutout having an upper edge and an opposing lower edge, wherein the upper and the lower edges are disposed entirely on distinct planes parallel to one another, each plane traversing the outermost lateral edge and the outermost medial edge;

a shock absorbing material positioned within and enclosed by the single cutout, the shock absorbing material sandwiched between the insole and a lower surface of the single cutout;

whereby said shock absorbing material is adapted for attenuating forces in the metatarsal region of user's foot while walking.

* * * * *